United States Patent [19]

Li et al.

[11] Patent Number: 4,753,762

[45] Date of Patent: Jun. 28, 1988

[54] PROCESS FOR FORMING IMPROVED FOAMED FIBERS

[75] Inventors: Hsin L. Li, Parsippany; Theodore Largman, Morristown; Frank Mares, Whippany; Hendrikus J. Oswald, Morristown, all of N.J.

[73] Assignee: Allied Corporation, Morris Township, Morris County, N.J.

[21] Appl. No.: 752,434

[22] Filed: Jul. 8, 1985

[51] Int. Cl.[4] ..... B29C 67/22; B29C 47/30; C08J 9/06

[52] U.S. Cl. ..... 264/54; 264/178 F; 264/210.7; 264/210.8; 264/288.8; 264/DIG. 5; 264/DIG. 13; 425/198; 425/199; 425/817 C

[58] Field of Search ..... 264/54, DIG. 13, DIG. 5, 264/178 F, 210.7, 210.8, 288.8; 425/817 C, 198, 199

[56] References Cited

U.S. PATENT DOCUMENTS

| | | | |
|---|---|---|---|
| 4,501,711 | 2/1985 | Senuma et al. | 264/DIG. 13 |
| 4,562,022 | 12/1985 | Li et al. | 264/54 |

FOREIGN PATENT DOCUMENTS

| | | |
|---|---|---|
| 2148588 | 4/1973 | Fed. Rep. of Germany . |
| 53-106770 | 9/1978 | Japan . |
| 1221488 | 2/1971 | United Kingdom . |
| 1296710 | 11/1972 | United Kingdom . |
| 1316465 | 5/1973 | United Kingdom . |
| 1318964 | 5/1973 | United Kingdom . |

*Primary Examiner*—Philip Anderson

*Attorney, Agent, or Firm*—Gus T. Hampilos; Richard C. Stewart; Gerhard H. Fuchs

[57] ABSTRACT

A method of forming foamed fibers which comprises the steps of forming a melt of a polymer of fiber-forming molecular weight in which is admixed a blowing agent, and a closed-cell-forming additive, extruding said melt through a spinnerette, quenching said melt downstream of said spinnerette under conditions at which bubbles form in said melt, and drawing said melt as it is quenched to produce a foamed fiber having fine bubbles contained therein is disclosed. The product fibers may contain substantially only closed-cells and/or substantially uniform cross sectional area cells.

15 Claims, 1 Drawing Sheet

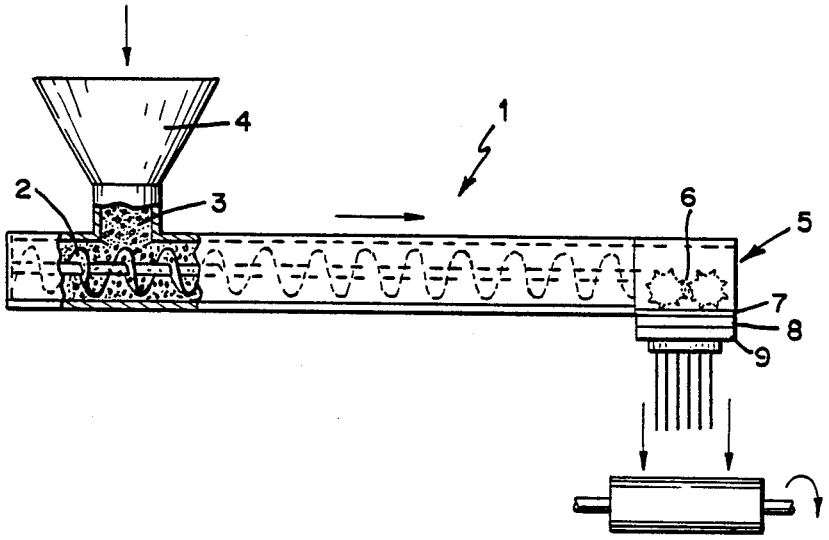
1
2
3
4
5
6
7
8
9

PROCESS FOR FORMING IMPROVED FOAMED FIBERS

BACKGROUND OF THE INVENTION

The present invention relates to a process for forming foamed fibers, and especially to processes employing a combination of molten polymer containing therein a dissolved decomposable compound or gaseous blowing agent and a closed-cell-forming additive which is extruded and subsequently quenched under conditions to produce an improved foamed fiber. The present invention also includes novel foamed fibers having essentially only closed-cell bubbles contained therein, and novel foamed fibers having substantially uniform cross sectional area cells formed therein.

Foamed thermoplastic (and especially polyamide) fibers have been produced, especially for the purpose of being broken (fibrillated) into three-dimensional structures of interrelated fiber elements. See, for example, U.K. Patent Specifications Nos. 1,316,465, 1,221,488, 1,296,710, and 1,318,964. In addition, foamed polyester and polyamide fibers for textile applications are disclosed in DOS No. 2,148,588 (Apr. 5, 1973) (See Example 7). See also Chem. Abstract 90:24692m (1979) of Japanese Kokai No. 78,106,770.

Hollow fibers, also known in the art, contain elongated voids extending generally or the entire length of the fiber in the longitudinal direction. Some of these fibers contain large diameter voids with low total void volume and find use in thermal insulation. The elongated voids are generally produced by the use of a modified spinning die.

U.S. application Ser. No. 490,070, entitled "Producing Foamed Fibers, " to H. L. Li et al., filed Apr. 29, 1983 and commonly assigned now U.S. Pat. No. 4,562,022, discloses improved methods of forming fine-celled foamed fibers which employs at least one additional member arranged above the spinnerette which, with extruding a polymer melt having a blowing agent admixed therewith, produces excellent foamed fiber products.

We have discovered a method of forming foamed fibers which contain fine, closed-cell bubbles, and/or cells of uniform cross sectional area. To that end, we have discovered a class of additives (hereinafter referred to as closed-cell-forming additives) which, when included in the polymer melt, produce improved foamed fibers. The use of the additive in a process for foaming fibers also dramatically enhances the ability to draw the fibers to produce very fine (on the order of 1 dpf) fibers (comprising open and/or closed cells) which are particularly useful as, for example, filter material, acoustic insulation, and apparel fiber.

SUMMARY OF THE INVENTION

The present invention is directed to a method of forming foamed fibers which comprises the steps of:

(a) forming a melt of a polymer of fiber-forming molecular weight in which is admixed a blowing agent and a closed-cell-forming additive;

(b) extruding said melt through a spinnerette;

(c) quenching said melt downstream of said spinnerette under conditions at which bubbles form in said melt; and (d) drawing said melt as it is quenched to produce a foamed fiber having fine, closed-cell bubbles contained therein and/or cells of uniform effective diameter. The closed-cell-forming additive comprises any one or more compounds selected from the group of siloxane polymers or copolymers thereof terminated at least at one end thereof by a group selected from relatively short (1–10 carbon) functionalized aliphatics, polyether alcohols and polyether amines. Preferably, the closed-cell-forming additive comprises any one or more compounds selected from the group of polydimethylsiloxane or copolymers thereof terminated at one end by polyether alcohols or polyether amines. The present invention also includes a foamed fiber having essentially closed-cell bubbles formed therein and/or cells of uniform cross sectional area. Foamed fibers (containing open and/or closed cell bubbles) may be formed as fine as about 1 dpf.

BRIEF DESCRIPTION OF THE DRAWING

The drawing illustrates a typical spinning and drawing apparatus which can be employed to practice the process of the present invention.

DETAILED DESCRIPTION OF THE INVENTION

The process of the present invention involves the extrusion of a polymer melt containing, or having dissolved or dispersed therein, a blowing agent which is a decomposable compound or a dissolved gas and a closed-cell-forming additive. The polymer may be any of a variety of conventional thermoplastics used in fiber production, for example: polyesters such as polyethylene terephthalate; polyamides such a nylon 6, nylon 6/6, nylon 4/6 and nylon 6/12; polyolefins; poly(vinylchloride) polystyrenes; and blends thereof. The preferred thermoplastics for use in the present invention are polyamides, especially nylon 6 and nylon 6/6. The polymers should be of fiber-forming molecular weight, a term well understood in the art. In the case of nylon 6 and nylon 6/6, a generally acceptable number average molecular weight is at least about 10,000.

The blowing agent may be a compound dissolved or dispersed in the molten polymer which, before reaching the spinning temperature, decomposes to form gases such as carbon dioxide, nitrogen, carbon monoxide or mixtures thereof. Materials which totally decompose to produce gaseous products such as nitrogen, ammonia, carbon dioxide, carbon monoxide and water vapor, or combinations of these are preferred. For example, azodicarbonamide decomposes to form nitrogen, carbon dioxide and ammonia in a 6:3:1 molar ratio. Azodicarbonamide, ethylene carbonate and oxalic acid are among the preferred materials. Oxalic acid, FICEL® azodicarbonamide, and Expandex® 5 PT (a 5-phenyl tetrazole, releasing $N_2$ only) are the most preferred materials. Less preferred, but suitable, are materials such as alkali metal carbonates and bicarbonates which decompose to form carbon dioxide and at least one nonvolatile by-product, or, for example, other sodium salts.

The blowing agent may also be a normally gaseous or volatile compound, such as a fluorocarbon or water mixed or injected into the polymer melt before or during extrusion. Samples of such blowing agents include carbon dioxide, nitrogen, noble gases, dichlorodifluoromethane, trichlorotrifluoroethane, water and volatile hydrocarbons, with nitrogen being the preferred blowing agent.

The decomposition temperature of the decomposable compound and boiling point of the normally-gaseous or volatile compound should be selected to assure that cells form in the polymer at the spinning temperature at the outlet of the spinnerette (as the pressure drops). These cells should not collapse or redissolve in the extended fiber prior to polymer solidificatron.

The concentration of the blowing agent or decomposable compound added to the polymer must be maintained above a certain amount in order to yield a sufficient number of cells to produce quality foamed fiber. The specific concentration is dependent upon a variety of factors including the degree of decomposition of the agent, the solubility of the gas(es) in the polymer, the amount of nucleating agent, the jet velocity of the fibers emerging from the spinnerette and the spinnerette design, among others, and can be determined by routine experimentation from the disclosure provided herein and/or upon viewing the cross sectional area of the fiber product to determine the presence or absence of closed and/or substantially uniform cross sectional area cells. Generally speaking, the concentration of blowing agent should be at least about 0.1% by weight and normally not more than about 0.6%. With FICEL ® EPA, (which contains about 50% nucleating agent) the amount is ordinarily at least about 0.3% by weight, with Expandex ® 5 PT the amount is normally at least about 0.2% by weight, and with oxalic acid the amount is normally above about 0.2% by weight.

To the polymer melt is ordinarily added a nucleating agent such as talc, silica (powdered or fumed), or magnesium or calcium carbonate. The nucleating agent may also be premixed with the decomposable compound as is the case of azo-compounds premixed with silica and sold by BFC Chemicals Inc., Wilmington, Del. as FICEL ® EPA, EPB, EPC, and EPD nucleating blowing agents. Alternatively, the nucleating agents may be separately mixed with the solid or molten polymer. A preferred nucleating agent is sold under the tradename MicroPflex ® 1200 by Pfizer. Ordinarily, the nucleating agent should be maintained at about 0.2% by weight or more. Generally, an azodicarbonamide/silica concentration ratio of about 2:1 is preferred. When employing an oxalic acid and talc combination, a concentration ratio of about 2:1 is preferred. The absence of nucleating agent tends to increase the size of the cells and may interfere in the production of extremely fine denier foamed fiber.

Admixed with the polymer, blowing agent and nucleating agent is a closed-cell-forming additive. The closed-cell-for-forming additive functions to stabilize and reduce the effective diameter of the bubbles formed in the polymer melt and results in the production of a molten foamed fiber having fine, substantially uniform cross sectional area, closed-cell bubbles formed therein. The closed-cell-forming additive comprises any one or more compounds selected from the group of siloxane polymers or copolymers thereof terminated at least at one end by a group selected from relatively short (1-10 carbon atoms, preferably 1-5 carbon atoms and most preferably 1-3 carbon atoms) functionalized aliphatics, polyether alcohols and polyether amines. The additive is represented by the formulae

A, (1)

AB, (2)

ABA, (3)

BAB, (4)

and $(AB)_x$ (5)

or mixtures thereof where $R_1$ and $R_2$ are independently selected from alkyl, hydroxy alkyl, aminio alkyl, alkoxy, alkoxy polyether, polyether alcohol, polyether amine and phenyl groups, $R_3$–$R_6$ are independently selected from alkyl and phenyl groups or mixtures thereof, n is an integer, A is a block polymer having the general formula:

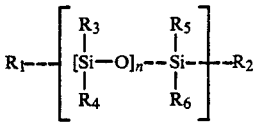

B is a polyether or polyamine, and x is an integer.

Preferably, the closed-cell-forming additive is any one or more compounds selected from the group of polydimethylsiloxane (i.e., where $R_3$–$R_6$ are methyl groups) or copolymers thereof terminated at least at one end thereof by a polyether alcohol, polyether amine or a relatively short functionalized (1-5 carbon atom containing) aliphatic group. More preferably, the polydimethylsiloxane based polymer is terminated at least at one end by a substituted alkyl having one to three carbon atoms, a polyether alcohol or a polyether amine. Most preferably, the substituted alkyl ($R_1$ and/or $R_2$) is propylamine or propanol. The closed-cell-forming additive is normally provided in an amount between about 5:1 to about 1:5 (ratio of additive to blowing agent). Preferably, the closed-cell-forming additive is provided in an amount between about 0.05% and about 1.0% by weight based on the polymer. More preferably, the additive is provided in an amount between about 0.15%-0.35%, and most preferably the additive is provided in an amount between about 0.2 and about 0.25% by weight.

The effect of the closed cell forming additive is twofold. Firstly, the additive is particularly useful in forming foamed fiber products containing substantially only closed cell bubbles. Fiber having a denier as low as about 1-3 dpf may be produced which exhibit this feature. Secondly, the closed-cell-forming additive unexpectedly enhances the ability to draw the spun fiber to produce extremely fine denier products (on the order of 1 dpf) due at least in part to the ability of the additive to decrease bubble size and increase the uniformity of the cross sectional area of the cell (open or closed). In accordance with this second advantage, a fiber cross section (normal to the fiber axis) will ordinarily show a decrease in cell size (diameter), an increase in the average number of voids and, perhaps more importantly, a range of void sizes larger than the average size which is decreased relative to a fiber formed in the absence of the closed-cell-forming additive.

Spinning apparatus used in practicing the extrusion step of our process may be conventional extrusion apparatus for spinning ordinary fibers of the same polymer with minor modifications. Thus, for example, in spinning nylon 6 fibers, ordinary powder or pellet feed systems, extruders and spinnerettes may be used. The spinnerette may have any number of apertures. Each aperture may have various L/D (length to diameter) ratios and various cross sectional shapes (e.g., circular, Y-shaped, dog-boned, hexalobal, and preferably trilobally-shaped). Regardless of the shape used, the effective diameter (in the case of a circle, an equivalent dimension giving the same cross sectional area for the other shapes) may vary widely from about 0.1 mm to about 2.0 mm, with an effective diameter from about 0.1 mm and about 1.0 mm being preferred, and between about 0.1 mm and about 0.6 mm being more preferred. Preferred 1/d ratios for the present invention are between about 30:1 and about 1:1, the lower range which is substantially less than that normally used for spinning polyamide fibers. Most preferably, the process employs a conventional extrusion apparatus having, as a principal modification thereof, at least one structure with a plurality of small openings defined therein, normally with a major cross sectional dimension of about 0.1 mm (the pore size of a porous member such as, for example, a sand pack or the mesh size of a screen) arranged upstream, and more preferably immediately upstream of the spinnerette. The most preferred modification is the employment of at least one screen pack as described in application Ser. No. 490,070 id., now U.S. Pat. No. 4,562,022, (the disclosure of which is hereby incorporated by reference to the extent not consistent herewith). Preferably, the screen pack should comprise screens having between about 20 mesh/in and about 400 mesh/in. Most preferably, we employ an eight layered screen pack comprising a 90 mesh top layer, followed by two 200 mesh layers, followed by two 400 mesh layers, followed by two 200 mesh layers, followed by a 90 mesh bottom layer.

For a particular polymer/blowing agent/nucleating agent/closed-cell forming additive combination, spinning pressures will generally have a particular minimum value below which good quality foamed fibers will not form. While spinning pressure can be controlled by a positive displacement melt pumps, the aperture size and arrangement in the spinnerette and the structural addition (e.g., screen pack) and its arrangement will have a significant effect on the spinning pressure. Consequently, the spinning pressure is ordinarily controlled by reference to the jet velocity of the polymer through the spinnerette (throughput rate of the polymer through the spinnerette in length/sec.). Although jet velocities as high as about 150 cm/sec may be used, jet velocities used in the process ordinarily range from about 2 cm/sec. to about 50 cm/sec., with 10–35 cm/sec. being the preferred range of velocity. Generally, an increase in the jet velocity will decrease the bubble size. More importantly, over the entire practical (ordinary) range of jet velocities, the closed-cell-forming additive functions to substantially reduce the cell (bubble) size as compared to the bubble size in an equivalent foamed fiber formed in the absence of the additive, and increases the uniformity of the cross sectional area thereof.

The extrusion technique generally used to form the molten foamed polymer may be any technique used in the extrusion of thermoplastics. Devices for blending the blowing agent or decomposable compound, nucleating agent and additive can be those well known in the art of fiber extrusion. For example, the decomposable compound may be master-batched with some of the polymer material in one extruder, which is then fed at right angles to a main extruder containing polymer material. The polymer material can be fed to the main extruder as a powder or as pellets. The extruder would generally feed a melt pump or other similar apparatus to create the high pressure (jet velocity) needed for fiber production. Additional conventional features include, for example, the polymer being heated in stages through the main extruder, and further heating of the polymer immediately before or after the melt pump.

Once the fiber is extruded through the spinnerette, the resultant molten fiber is quenched downstream of the spinnerette under conditions at which bubbles will form and are stabilized in the molten fiber. Such bubbles will contain, for example, carbon dioxide, may contain other by-products of compound decomposition (e.g., nitrogen and ammonia) and may also contain other volatile materials which are added as such to the polymer melt (e.g., fluorocarbons). The quench temperature should be below the temperature at which the molten fibers solidify. Furthermore, the quench temperature is generally within several degrees of room temperature (e.g., about 20° C.) and should be chosen such that bubble coalescence, bubble diffusion to the polymer surface and redissolution are minimized.

As the melt is quenched, it is normally drawn (melt drawn) so as to control the diameter (or the denier) of the fiber to a desired degree. Because of the high viscosities of most fiber-forming polymer materials, it is conventional to extrude through spinnerette apertures of major cross sectional dimensions much larger than the desired final fiber product dimension. Furthermore, since, once the molten fiber has solidified, it is relatively difficult to draw to a large extent (e.g., more than about 5:1), the most appropriate place to draw is during the molten state and the quenching operation. In the present process, melt drawing is affected at a draw ratio of between about 2:1 and about 1000:1; and, at least in the case of polyamides, it is preferably between about 4:1 and about 200:1. As one aspect of our invention, we have discovered that an essentially closed-cell bubble structure can be formed during the quenching operation which is neither destroyed nor rendered open cell by the drawing step, even when producing fibers having a denier as fine as about 1–3 dpf. Instead there may be some tendency for bubbles to elongate somewhat in the longitudinal direction.

Because of the addition of the closed-cell forming additive, the product fibers from the above process generally exhibit a generally of very fine, uniform diameter bubble structure and hence are of more substantial physical properties than fibers produced in accordance with any previously mentioned process. Thus, for example, in product fibers having a denier (grams per 9000 meters) of between about 1 and 100, a representative cross section of each filament normally exhibits between about 50 and about 200 percent more bubbles than would be possible in the absence of the closed-cell forming additive. Ordinarily, the total cross sectional area of the bubbles per given cross sectional area of, for example, nylon fiber product will amount to between about 10 and about 40 percent of the cross sectional area of the fiber. Moreover, we have discovered that the uniformity of and decreased cross sectional area of the fine cells increases the drawability of the spun fiber. Consequently, fibers on the order of 1 dpf can be continuously produced.

The fiber product ordinarily has an effective diameter of between about 0.01 mm and about 1.0 mm, preferably between about 0.01 mm and about 0.1 mm. Effective diameter corresponds generally to a denier which can range from about 0.8 to about 8000, and which preferably ranges between about 0.8 and about 80. Excellent carpets can be formed from such fibers, especially with deniers from about 15 to about 30. Not only would such carpets have added coverage without the loss of such properties as wearability and resilience, but they would also exhibit excellent resistance to accumulating dirt due to the essentially closed-cell structure of the fiber product. Moreover, continuous fibers of extremely low denier (on the order of 1 dpf) may be produced which would be especially useful in the production of apparel and as filter elements.

The density of the foamed fibers will normally be between about 60 and about 90 percent of the density of unfoamed fibers of the same composition. In other words, the volume of polymer in the foamed fiber is ordinarily at least about 10% and normally between about 10% and about 40% less than the volume of polymer in an unfoamed fiber of the same cross sectional dimension and length. Accordingly, since denier is based upon weight, lower denier fibers of the same cross sectional area are created. The cells (bubbles) in such fibers have an effective diameter (as measured in a cross section of the fiber taken generally normal to the fiber axis) less than about 10 microns, normally less than about 2 micron, and in many instances less than or equal to about 1 micron. In essentially all instances, the foamed fiber produced in accordance with our process comprises bubbles of substantially smaller size and relatively uniform cross sectional area as compared to the bubbles in foamed fibers formed without the use of the additive. Moreover, except for extremely low denier fiber (i.e., less than about 1 denier), the cells may exist as essentially only closed cells (in the sense that a photograph of the cross section of the product fiber would show that essentially all the bubbles present over the given cross section of the fiber are substantially closed).

In addition to the uses mentioned above for the foamed fibers, they may also be used in upholstery, camping equipment (e.g., tents and sleeping bags), luggage, ropes, or nets. The foamed fibers may be formed for such applications in woven and nonwoven fabrics, or they may be tufted or otherwise fabricated in ways conventional for nonfoamed fibers.

The following Examples describe the production of essentialy closed-cell-containing and/or substantially uniform cross section cell containing foamed fibers which were spun using an apparatus of the type schematically illustrated in the FIG. 1. The apparatus comprises a heated extruder barrel 1 containing an extrusion screw 2 which propels a mixture 3 of polymer, decomposable compound, nucleating agent and closed-cell forming additive (fed to the barrel via the hopper 4) toward a spinning apparatus 5. Within the spinning apparatus 5, a positive displacement melt pump 6 feeds the molten polymer mixture through a distributor plate 7 and a screen pack 8 toward the spinnerette 9. A continuous fiber product is produced by the spinnerette and is subsequently stretched and quenched (melt drawn) by suitable means not shown, and thereafter the solidified fiber is drawn to the final desired denier by suitable means (e.g., rollers, not shown). The Examples should not be construed in any way as limiting the scope of applicants' invention to anything less than that which is defined by the appended claims.

COMPARATIVE EXAMPLE 1

2 Kg of nylon 6 polymer pellets were coated with 9 g of a chemical blowing agent, Expandex® 5 PT (a 5-phenyltetrazole produced by Olin Corporation) and 9 g of a nucleating agent, MicroPflex-1200 (a submicron, chemically treated synthetic magnesium silicate), using 4 g of vegetable oil as a binder. The coating was done by adding the ingredients to a jar, which was sealed and tumbled (for about 30 min.) until the blowing and nucleating agents were uniformly distributed onto the polymer pellets. On a polymer basis, the concentration of the additives are, respectively, 0.45 wt. %, 0.45 wt. %, and 0.20 wt. %. The anhydrous mixture was placed in the hopper of a one inch diameter extruder which was preheated to the desired temperature profile along the barrel of the extruder to yield a polymer melt temperature at the exit of the extruder of about 500° F. The extruder was equipped with a metering pump and a spinning block containing the screens (eight layers, 90, 200, 200, 400, 400, 200, 200, 90 mesh, top to bottom) and a spinnerette. The spinnerette had five (5) symmetrical trilobal orifices, wherein each lobe has dimensions (mils) of 5 (width)×20 (length)×20 (depth). The area per orifice was $1.8\times10^{-3}cm^2$. The polymer-additive mixture was extruded at a rate of 13.6 g/m which translated into a jet velocity of 25 cm per sec. per orifice. It required a metering pump setting of 12.5 rpm and an extruder screw rpm sufficient to maintain about 2000 psi at the entrance to the metering pump. The pressure after the metering pump, but before the screen and spinnerette, was measured to be about 1180 psi. The filaments exiting from the spinnerette orifices were drawn down (melt drawn) to a 29:1 ratio (56 dpf) while being cooled in air to a temperature at which the filaments did not stick to the surface of a first take-up roll, less than about 50° C. Just above the first take-up roll, a finish was applied to the yarn to aid further processing and to dissipate any static charge buildup. The yarn on the first take-up roll was then drawn in line. The yarn on the first roll which turned at 874 rpm (437 MPM yarn speed) was advanced to a second roll which turned at 960 rpm (480 MPM) and from the second roll onto a third roll which turned at 1786 rpm (yarn speed of 893 MPM). The yarn was then advanced from the third roll to a winder at 893 MPM, which wound the yarn upon a sleeve. The temperature of the rolls (heated by induction heating) were 55° C. 163° C. and 23° C. for rolls 1, 2, and 3, respectively. The difference in roll speeds resulted in an overall draw ratio of 2.04:1. The final drawn foamed yarn floated in a liquid with a density of 0.9 g/cc and had a denier of 135/5 (27 dpf). An analysis of 60 cross sections showed an average number of voids of 7.3 per cross section with an average size of 11.3 microns, and a range of voids (9) having a cross section larger than the average of 13–16.7 microns.

EXAMPLE 2

The vegetable oil which functioned to bind the Expandex® 5 PT blowing agent and the nucleating agent to the polymer pellets was replaced by 0.25 wt. % of a polydimethylsiloxane containing a secondary hydroxyl function (Dow Corning DC-Q1-8030). The polymer, additives, and resulting yarn were processed in the same manner as in Example 1. The resulting yarn had a denier of 135/5 (27 dpf) and also floated in a liquid with a density of 0.9 g/cc. An analysis of 60 cross sections revealed an average number of 12 voids per cross section. The void size averaged 10 microns. The addition of the closed-cell-forming additive substantially increased the average number of voids from 7.3 in Example 1 to 12 in this test. Moreover, the voids were substantially closed. In addition, the range of voids (13) having a cross section larger than the average decreased to 11–13.8.

EXAMPLE 3

Nylon 6 polymer pellets were coated with Expandex® 5 PT blowing agent and MicroPflex-1200 nucleating agent, using the Dow Corning Q1-8030 additive. The coating was accomplished as in Example 1, except that on a polymer basis, the concentration of the additives were respectively, 0.40 wt. %, 0.30 wt. %, and 0.20 wt. %. The apparatus of Example 1 was employed, except that the spinnerette used had ten (10) symmetrical trilobal orifices having dimensions (mils) of $5\times20\times20$. The area per orifice was $1.8\times10^{-3}cm^2$. The polymer-additive mixture was extruded at a rate sufficient to yield a jet velocity of 41 cm/sec per orifice. It required a metering pump setting of 34.5 rpm and an extruder screw rpm sufficient to maintain about 2450 psi (polymer temperature about 555° F. at the exit of the extruder) at the entrance to the metering pump. The pressure after the meter pump, but before the screen and spinnerette was measured at about 1100 psi. The filaments exiting from the spinnerette orifices were drawn down at a 27:1 ratio while being cooled in air to a temperature where the filaments (53 dpf) did not stick to the surface of the first take-up roll. Again, just above the first take-up roll, a finish was applied to the yarn to aid further processing and to dissipate any static charge buildup. The yarn on the first roll was drawn in line. The yarn on the first roll which turned at 672 MPM was advanced to a second roll which turned at 1746 MPM and from the second roll onto a third roll which turned at 1746 MPM. The yarn was then advanced from the third roll to a winder at 1746 MPM, which wound the yarn upon a sleeve. The temperature of the rolls was approximately 43° C., 161° C., and 23° C. for rolls 1, 2, and 3, respectively. The difference in roll speeds resulted in overall draw ratio of 2.6:1. The final drawn yarn floated in a liquid with a density of 0.85 g/cc and had a denier of 200/10 (20 dpf). An analysis of 60 cross sections revealed a average number of 13 voids per cross section with an average size of 6.6 microns, and a range of voids (10) having a cross section larger than the average of 7.5–9.2 microns.

COMPARATIVE EXAMPLE 4

Nylon polymer pellets were coated with the chemical blowing agent comprising caprolactam, oxalic acid, and a nucleating agent (MicroPflex-1200). The coating was accomplished by adding the ingredients to a jar which was then closed and tumbled until all additives were uniformly distributed onto the polymer pellets (about 30 min). On a polymer basis, the concentration of the additives was 0.2 wt. % oxalic acid, 0.2 wt. % MicroPflex-1200 and 0.4 wt. % caprolactam. The anhydrous mixture was placed in the hopper of a one inch diameter extruder which was preheated to the desired temperature profile along the barrel of the extruder to yield a polymer melt temperature at the exit of the extruder of about 503° F. The extruder was equipped with a metering pump and a spinning block containing the screen (designed as in Example 1) and a spinnerette. The spinnerette had five (5) symmetrical trilobal orifices having dimensions (mils) of $5\times20\times20$. The area per orifice was $1.8\times10^{-3}cm^2$. The polymer-additive mixture was extruded at a rate of 27 g/m which translated into a jet velocity of 50 cm/sec per orifice. It required a metering setting of 24 rpm and an extruder screw rpm sufficient to maintain about 2000 psi at the entrance to the metering pump. The pressure after the metering pump, but before the screen and spinnerette, was measured to be about 1209 psi. The filaments exiting from the spinnerette orifices were drawn down to a 28:1 ratio (59 dpf) while being cooled in air to a temperature below about 50° C. Again, as in the previous examples, a finish was applied to the yarn to aid further processing and to dissipate any static charge buildup. The yarn on the first roll was then drawn in line. The yarn on the first roll which turned at 830 MPM was advance to a second roll which turned at a yarn linear velocity of 900 MPM and from the second roll onto a third roll which turned at a yarn speed of 1890 MPM. The yarn was then advanced from the third roll to a winder at 1890 MPM, which wound the yarn upon a sleeve. The temperature of the rolls was 65° C., 162° C., and 23° C. for roll 1, 2, and 3, respectively. The difference in roll speeds resulted in an overall draw ratio of 2.27. The final drawn yarn floated in a liquid with density of 0.9 g/cc and had a denier of 130/5 (26 dpf) An analysis of 60 cross sections showed an average number of voids of 4.1 per cross section with an average size of 12.5 microns, and a range of voids (8) having a cross section larger than the average of 14–23.6 microns.

EXAMPLE 5

Nylon 6 polymer pellets were coated with oxalic acid, a nucleating agent (MicroPflex-1200), and the additive of Example 2 (Dow Corning DC-Q1-8030). On a polymer basis, the concentrations of the additions were 0 175 wt. % oxalic acid, 0.2 wt. % Microflex-1200, and 0.2 wt. % closed-cell-forming additive. The mixture was extruded through the barrel of the extruder described in Example 4. The polymer melt temperature at the exit of the extruder was about 518° F. The spinnerette had twenty (20) symmetrical trilobal orifices having dimensions (mils) of $4\times10\times10$. The area per orifice was $6.2\times10^{-4}cm^2$. The polymer additive mixture was extruded at a rate of 23.4 g/min which translated into a jet velocity of 32 cm/sec per orifice. It required a metering pump setting of 20 rpm and an extruder screw rpm sufficient to maintain about 1800 psi of pressure at the entrance to the metering pump. The pressure after the metering pump, but before the screen and spinnerette, was measured to be about 600 psi. The filaments exiting from the spinnerette orifices were drawn down to a 46.6:1 ratio (12 dpf) while being cooled in air to below 50° C. As in the previous examples, a finish was applied to the yarn to aid further processing and dissipate any static charge buildup. The yarn of the first roll was then drawn in line. The yarn on the first roll which turned at 880 MPM was advanced. to a second roll which turned at a velocity of 1653 MPM and from the second roll to a third roll which also turned at a speed of 1653 MPM. The yarn was then advanced from the third roll to a winder at 1653 MPM, which wound upon a sleeve. The temperature of the rolls were 79° C., 98° C., and 23° C. for roll 1, 2, and 3, respectively. The difference in roll speeds resulted in an overal draw ratio of 1.87:1. The final drawn yarn floated in a liquid with the density of 0.9 g/cc and had a denier of 128/20 (6.4 dpf) An analysis of 60 cross sections showed an average number of voids of 11.2 per cross section with an average size of 3.4 microns, and a range of voids (9) having a cross-section larger than the average of 4.1–5.1 microns.

EXAMPLE 6

Polyethylene terepthalate pellets were blended with 0.3 wt. % Expandex® 5 PT blowing agent, 0.3 wt. % MicroPflex-1200 (nucleating agent) and 0.15 wt. % of the additive of Example 2 (Dow Corning DC-Q1-8030). The mixture was extruded through a one inch diameter extruder which was preheated to the desired temperature profile along the barrel of the extruder to yield a polymer melt temperature at the exit of the extruder of about 553° F. The extruder was equipped with a metering pump at a spinning block containing the screens (designed as in Example 1) and the spinnerette. The spinnerette had twenty (20) symmetrical trilobal orifices having dimensions (mils) of $4\times15\times14$. The area per orifice was $1.1\times10^{-3}cm^2$. The polymer-additive mixture was extruded at a rate of 24.5 g/min which translated into a jet velocity of 18.6 cm/sec per orifice. It required a metering pump setting of 18 rpm and an extruder screw rpm sufficient to maintain about 2400 psi at the entrance to the metering pump. Pressure after the metering pump, but before the screen and spinnerette, was measured to be about 1890 psi. The filaments exiting from the spinnerette orifices were drawn down to 22.5 denier per 20 fil. (6.2 dpf). The yarn was then drawn in line to a final draw ratio of 1.96. The final drawn yarn floated in water (density 1.00 g/cc) and had a final denier of 64/20 (3.2 dpf). A visual inspection of the yarn cross sections showed an average number of voids of 11 per filament cross section with a size ranging from very small to medium diameter.

COMPARATIVE EXAMPLE 7

The closed-cell-forming additive employed in the process described in Example 6 was replaced with vegetable oil. The polymer, additives, and resulting yarn were processed in essentially the same manner as in Example 6. The resulting yarn had a denier of 136 (6.8 dpf) and floated in a liquid with a density of 1.10 g/cc. A visual inspection of the yarn cross section revealed an average number of 6 voids per filament cross section. The size of the voids ranged from medium to large in diameter.

EXAMPLE 8

Nylon 6 polymer pellets were coated with Expandex® 5-PT blowing agent, MicroPflex-1200 nucleating agent, and a low molecular weight silicone with terminal hydroxyl groups (produced by Goldschmidt and distributed under the tradename Goldschmidt CK 150). The coating was accomplished as in Example 1, except that on a polymer basis, the concentrations of the additions were, respectively, 0.40 wt. %, 0.30 wt. %, and 0.20 wt. %. The apparatus of Example 1 was employed, except that the spinnerette used had ten (10) symmetrical trilobal orifices having dimensions (mils) of $5\times20\times10$. The area per orifice was $1.8\times10^{-3}cm^2$. The polymer-additive mixture was extruded at a rate sufficient to yield a jet velocity of 36.1 cm/sec. per orifice. It required a metering pump setting of 34.5 rpm and an extruder screw rpm sufficient to maintain about 2800 psi at the entrance to the metering pump. The pressure after the metering pump, but before the screen and spinnerette was measured at about 1300 psi. The filaments exiting the spinnerette were drawn while being cooled in air to a temperature where the filaments did not stick to the surface of the first take-up roll. Just above the first take-up roll, a finish was applied to the yarn to aid further processing and to dissipate any static charge buildup. The yarn on the first roll was drawn in line. The yarn on the first roll which turned at 1624 rpm was advanced to a second roll which turned at 3492 rpm and from the second roll onto a third roll which turned at 3492 rpm. The yarn was then advanced from the third roll to a winder of 3492 rpm, which wound the yarn upon a sleeve. The temperature of the rolls was approximately 65° C., 150° C., and 23° C. for the rolls 1, 2, and 3, respectively. The differences in roll speeds resulted in an overall draw ratio of 2.15:1. The final yarn floated in a liquid with a density of 0.85 g/cc and had a denier of 200/10 (20 dpf). A visual count of 10 cross sections revealed an average of 35 voids per cross section.

EXAMPLE 9

Nylon 6 polymer pellets were coated with Expandex® 5-PT blowing agent, MicroPflex-1200 nucleating agent, a solution of a silicone containing amine functionality in 50% white mineral spirits (produced by Goldschmidt and distributed under the tradename Goldschmidt Tegosivin L49). The coating was accomplished as in Example 1, except that on a polymer basis, the concentration of the additive were respectively, 0.40 wt. %, 0.30 wt. %, and 0.40 wt. %. The apparatus of Example 1 was employed, except that the spinnerette used had ten (10) symmetrical trilobal orifices having dimensions (mils) of $5\times20\times10$. The area per orifice was $1.8\times10^{-3}cm^2$. The polymer-additive mixture was extruded at a rate sufficient to yield a jet velocity of 36.1 cm/sec. per orifice. It required a metering pump setting of 34.5 rpm and an extruder screw rpm sufficient to maintain about 2600 psi at the entrance to the metering pump. The pressure after the metering pump, but before the screen and spinnerette was measured at about 1170 psi. The filaments existing from the spinnerette were drawn while being cooled in air to a temperature where the filaments did not stick to the surface of the first take-up roll. Just above the first take-up roll, a finish was applied to the yarn to and further processing and to dissipate any static charge buildup. The yarn on the first roll was drawn in line. The yarn on the first roll which turned at 1624 rpm was advanced to a second roll which turned at 3492 rpm and from the second roll onto a third roll which turned at 3492 rpm. The yarn was then advanced from the third roll to a winder of 3492 rpm, which wound the yarn upon a sleeve. The temperature of the rolls was approximately 65° C., 150° C., and 23° C. for the rolls 1, 2, and 3, respectively. The differences in roll speeds resulted in an overall draw ratio of 2.15:1. The final yarn floated in a liquid with a density of 0.85 g/cc and had a denier of 200/10 (20 dpf). A visual count of 10 cross sections revealed an average of 23 voids per cross section.

COMPARATIVE EXAMPLE 10

Nylon 6 polymer pellets were coated with Expandex® 5-PT blowing agent, and and MicroPflex-1200 nucleating agent, and a solution of a silicone containing amine functionally in 50% white mineral spirits (produced by Goldschmidt and distributed under the tradename Goldschmidt Tegosivin L50). The coating was accomplished as in Example 1, except that on a polymer basis, the concentration of the additive were, respectively, 0.40 wt. 0.30 wt. %, and 0.67 wt. %. The apparatus of Example 1 was employed, except that the spinnerette used had ten (10) symmetrical trilobal orifices having dimensions (mils) of $5\times20\times10$. The area per orifice was $1.8\times10^{-3}cm^2$. The mixture was extruded at a rate sufficient to yield a jet velocity of 36.1 cm/sec. per orifice. It required a metering pump setting of 34.5 rpm and an extruder screw rpm sufficient to maintain about 2400 psi at the entrance to the metering pump. The pressure after the metering pump, but before the screen and spinnerette was measured at about 1260 psi. The filaments existing from the spinnerette were drawn while being cooled in air to a temperature where the filaments did not stick to the surface of the first take-up roll. Just above the first take-up roll, a finish was applied to the yarn to and further processing and to dissipate any static charge buildup. The yarn on the first roll was drawn in line. The yarn on the first roll which turned at 1624 rpm was advanced to a second roll which turned at 3492 rpm and from the second roll onto a third roll which turned at 3492 rpm. The yarn was then advanced from the third roll to a winder of 3492 rpm, which wound the yarn upon a sleeve. The temperature of the rolls was approximately 65° C., 150° C., and 23° C. for the rolls 1, 2, and 3, respectively. The differences in roll speeds resulted in an overall draw ratio of 2.15:1. The final yarn floated in a liquid with a density of 0.79 g/cc and had a denier of 200/10 (20 dpf). A visual count of 10 cross sections revealed an average of 34 voids per cross section.

We claim:

1. A method of forming foamed fibers which comprises the steps of:

(a) forming a melt of a thermoplastic polymer of fiber-forming molecular weight in which is admixed a blowing agent and a closed-cell-forming additive comprising a material selected from the group of:

A, AB, ABA, BAB, and $(AB)_x$ and mixtures thereof, wherein A is a block polymer having the general formula:

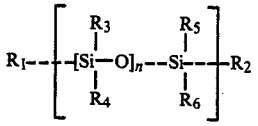

where $R_1$ and $R_2$ are independently selected from alkyl, hydroxy alkyl, amino alkyl, alkoxy, alkoxy polyether, polyether alcohol, polyether amine, and phenyl groups, $R_3$–$R_6$ are independently selected from alkyl and phenyl groups or mixtures thereof, n is an integer, B is a polyether or polyether or polyamine, and x is an integer;

(b) extruding said melt through a spinnerette;

(c) quenching said melt downstream of said spinnerette under conditions at which bubbles form and are stabilized in said melt; and (d) drawing said melt as it is quenched, thus producing a foamed fiber having a void volume formed essentially from substantially closed cells.

2. The process of claim 1 wherein the step of forming a melt further comprising admixing a nucleating agent with the polymer.

3. The process of claim 2 wherein $R_3$, $R_4$, $R_5$ and $R_6$ are methyl.

4. The process of claim 3 wherein $R_2$ is an amino-substituted alkyl.

5. The process of claim 3 wherein $R_2$ is a hydroxyl-substituted alkyl.

6. The process of claim 3 wherein the closed-cell-forming additive and the blowing agent are in amounts such that the ratio of closed-cell-forming additive to blowing agent is between about 5:1 and about 1:5.

7. The process of claim 6 wherein the blowing agent is provided in an amount of at least about 0.1% by weight.

8. The process of claim 6 wherein the blowing agent is provided in an amount of at least about 0.2% by weight.

9. The process of claim 8 wherein the nucleating agent is added in an amount of at least about 0.2 wt. %.

10. The process of claim 1 wherein the polymer is selected from the group of polyesters, polyamides, polyolefins, polyvinyl chloride, polystyrenes and blends thereof.

11. The process of claim 1 wherein the polymer comprises nylon.

12. The process of claim 6 wherein the blowing agent comprises a material selected from the group of oxalic acid, azodicarbonamide and phenyltetrazole.

13. The process of claim 4 wherein said amino substituted alkyl includes from one to about three carbon atoms.

14. The process of claim 5 wherein said hydroxyl substituted alkyl includes from one to about three carbon atoms.

15. The process of claim 3 wherein $R_1$ and $R_2$ are selected from the group consisting of propylamine and propanol.

* * * * *

UNITED STATES PATENT AND TRADEMARK OFFICE

CERTIFICATE OF CORRECTION

PATENT NO. : 4,753,762

DATED : June 28, 1988

INVENTOR(S) : H.L. Li et al.

It is certified that error appears in the above-identified patent and that said Letters Patent is hereby corrected as shown below:

Col. 1, line 36: "assigned now" should read -- assigned and now --.

Col. 3, line 51: "closed-cell-for-forming" should read -- closed-cell-forming --.

Col. 9, line 46: "a average" should read -- an average --.

Col. 10, line 37: "0 175 wt. %" should read -- 0.175 wt. % --.

Col. 11, line 29: "22.5 denier" should read -- 122.5 denier --.

Col. 13, line 2: "0.40 wt." should read -- 0.40 wt. %, --.

Col. 14, line 4: "B is a polyether or polyether or" should read -- B is a polyether or --.

Signed and Sealed this

Twenty-ninth Day of November, 1988

*Attest:*

DONALD J. QUIGG

*Attesting Officer*

*Commissioner of Patents and Trademarks*